US006412794B1

(12) United States Patent
Phillips et al.

(10) Patent No.: US 6,412,794 B1
(45) Date of Patent: Jul. 2, 2002

(54) FASTENING ASSEMBLY AND METHOD FOR SECURING FOOTWEAR TO A BINDING

(75) Inventors: Franklin S. Phillips, Richmond, VT (US); Christian Breuer, Botzingen (DE); Graham Scott Taylor, Moscow; Jake Burton Carpenter, Stowe, both of VT (US)

(73) Assignee: The Burton Corporation, Burlington, VT (US)

( * ) Notice: Subject to any disclaimer, the term of this patent is extended or adjusted under 35 U.S.C. 154(b) by 0 days.

(21) Appl. No.: 09/704,233

(22) Filed: Nov. 1, 2000

(51) Int. Cl.[7] ..... B62B 9/04
(52) U.S. Cl. ..... 280/14.22; 36/50.5; 24/685 K
(58) Field of Search ..... 36/117.1, 117.2, 36/117.6, 117.7, 118.1, 118.5, 119.1, 122, 125, 50.5; 280/14.21, 14.22, 14.24, 613, 617, 618, 619, 620, 624, 633, 637; 24/285 K, 695 K, 705 K, 715 K

(56) References Cited

U.S. PATENT DOCUMENTS

| | | | | | |
|---|---|---|---|---|---|
| 599,495 | A | * | 2/1898 | Durel et al. | 36/122 |
| 3,909,027 | A | * | 9/1975 | Salomon | 280/637 |
| 4,193,171 | A | | 3/1980 | Lichowsky | 24/68 SK |
| 4,979,760 | A | * | 12/1990 | Derrah | 280/607 |
| 5,142,798 | A | * | 9/1992 | Kaufman et al. | 36/117.4 |
| 5,172,454 | A | * | 12/1992 | Martignago | 24/68 SK |
| 5,713,587 | A | * | 2/1998 | Morrow et al. | 280/14.2 |
| 5,727,339 | A | * | 3/1998 | Owen | 36/132 |
| 5,745,959 | A | | 5/1998 | Dodge | 24/68 SK |
| 5,758,895 | A | | 6/1998 | Bumgarner | 280/607 |
| 5,852,852 | A | | 12/1998 | Rigal | 24/68 R |
| 5,970,632 | A | | 10/1999 | Watson | 36/122 |
| 6,056,300 | A | * | 5/2000 | Carpenter et al. | 280/14.2 |
| 6,099,018 | A | * | 8/2000 | Maravetz et al. | 280/624 |
| 6,347,805 | B1 | * | 2/2001 | Maravetz et al. | 280/14.22 X |
| 6,206,403 | B1 | * | 3/2001 | Black et al. | 280/618 |
| 6,276,708 | B1 | * | 8/2001 | Hogstedt | 280/14.22 X |

FOREIGN PATENT DOCUMENTS

| | | | |
|---|---|---|---|
| CH | 248233 | * | 1/1948 |
| CH | 316787 | * | 10/1956 |
| DE | 474332 | * | 3/1929 |
| DE | 486817 | * | 11/1929 |
| DE | 169185 | * | 2/1951 |
| DE | 197257 | * | 4/1958 |
| DE | 268951 | * | 2/1969 |
| FR | 869549 | * | 1/1941 |
| FR | 1110048 | * | 10/1955 |
| FR | 2 019 992 A | | 7/1970 |
| NO | 15420 | * | 8/1906 |
| NO | 37206 | * | 4/1923 |
| WO | 97 34508 A | | 9/1997 |
| WO | 99 34699 A | | 7/1999 |

OTHER PUBLICATIONS

Attached photographs of a white strap with a gray and white buckle that was sold or offered or sale at least as of Nov. 1, 1999.

* cited by examiner

*Primary Examiner*—Brian L. Johnson
*Assistant Examiner*—Bryan Fischmann
(74) *Attorney, Agent, or Firm*—Wolf, Greenfield & Sacks, P.C.

(57) ABSTRACT

A fastening assembly and method for fastening a strap, such as a snowboard binding strap. A fastener may have guide members to facilitate the introduction of an engagement member with the fastener. The fastener may be attached to a strap to allow physical manipulation of the fastener, e.g., for alignment of the fastener with an engagement member, without requiring substantial movement of the strap.

58 Claims, 5 Drawing Sheets

FASTENING ASSEMBLY AND METHOD FOR SECURING FOOTWEAR TO A BINDING

FIELD OF THE INVENTION

The present invention relates generally to a method and apparatus for fastening an article of footwear, or a foot, to a binding.

DESCRIPTION OF RELATED ART

Binding systems for soft snowboard boots typically include one or more binding straps for securing a boot to a snowboard. For example, a binding may include an ankle strap and a toe strap, each of which include two strap portions that, when separated, provide an opening for the rider to place his or her foot into the binding base. The strap portions may then be joined together and tightened around the boot to securely hold the boot to the binding base.

Strap portions may be joined together by a variety of different fasteners, such as ratchet-type buckles that are shown in U.S. Pat. Nos. 5,416,952 and 5,745,959, which are hereby incorporated by reference in their entirety. In a typical binding strap having a ratchet-type buckle, the buckle is mounted on a first strap portion and releasably engages with a second strap portion. The second strap portion may include a rack of teeth or serrations on a surface to engage with the ratchet buckle. The ratchet buckle may include a drive lever to incrementally draw the first and second strap portions together.

Easy use of the straps may be important to a rider as a day of riding may involve numerous occurrences of releasing and re-securing the boot binding straps. The inventors have recognized that the fastening of the two binding strap portions together may be difficult while wearing gloves or mittens, especially for children, since the buckle must be accurately positioned with one hand while the strap is then aimed and precisely advanced into the buckle with the other hand. Also, cold weather may reduce a rider's dexterity and/or stiffen the straps and, therefore, impair his or her ability to easily fasten two strap portions to one another.

SUMMARY OF THE INVENTION

One illustrative embodiment of the invention provides a system for binding a foot or footwear to a gliding implement. The system includes a base, mountable to the gliding implement, having an opening adapted to receive the foot or footwear. A stiff elongated foot or footwear binding strap portion and an elongated foot or footwear binding engagement member are adapted to be mounted to the base. A hand holdable fastener is mounted to the stiff elongated strap portion and arranged to secure the elongated engagement member so that the stiff elongated strap portion and the elongated engagement member cooperate to form a variable length binding member extending across the opening. The fastener is arranged for movement independent of said stiff elongated strap portion, to which it is mounted, in at least two degrees of freedom.

In another illustrative embodiment, a strap sub-assembly that is mountable to a foot supporting implement, such as an article of footwear or a footwear binding, is provided. The strap sub-assembly can cooperate with a separate engagement member to provide a variable length strap for engaging at least a portion of a foot or footwear. The sub-assembly includes a strap constructed and arranged for mounting to the foot supporting implement, and is conformable to the shape of a region of the foot or footwear against which it may be forcibly tightened to secure the foot or footwear to the foot supporting implement. A hinge-type connection is attached to the strap, and a fastener having an entrance for receiving an end of an engagement member is attached to the hinge-type connection. The hinge type connection is not required for operation of the fastener to engage with the engagement member.

In another illustrative embodiment, a strap sub-assembly that is mountable to a foot supporting implement, such as an article of footwear or a footwear binding, is provided. The strap sub-assembly can cooperate with a separate engagement member to provide a variable length strap for engaging at least a portion of the foot or footwear. The sub-assembly includes a first strap portion constructed and arranged for mounting to the foot supporting implement, and is conformable to the shape of a region of the foot or footwear against which it may be forcibly tightened about to secure the foot or footwear to the foot supporting implement. A fastener is attached to the first strap portion so that the fastener may be spaced from the first strap portion and entirely grasped in one hand without grasping the first strap portion.

In another illustrative embodiment, a strap sub-assembly that is mountable to a foot supporting implement, such as an article of footwear or a footwear binding, is provided. The strap sub-assembly can cooperate with a separate engagement member to provide a variable length strap for engaging at least a portion of the foot or footwear. The sub-assembly includes a first elongated strap having a portion thereof that is constructed and arranged for mounting to the foot supporting implement, and is conformable to the shape of a region of the foot or footwear against which it may be forcibly tightened about. A fastener, having an entrance for receiving an end of the engagement member, is mounted to said first elongated strap so that said entrance extends beyond an end of said first elongated strap.

In another illustrative embodiment, a method for fastening two straps together includes placing an article of footwear into a binding, grasping a fastener with one hand, the fastener being attached to an associated first strap, and grasping a second strap with another hand. The fastener is moved without substantially moving the first strap in preparation for engaging the second strap with the fastener, and the second strap is engaged with the fastener.

In another illustrative embodiment, a strap sub-assembly that is mountable to a foot supporting implement, such as an article of footwear or a footwear binding, is provided. The strap sub-assembly can cooperate with a separate engagement member to provide a variable length strap for engaging at least a portion of the foot or footwear. The sub-assembly includes a first elongated strap having a portion thereof that is constructed and arranged for mounting to the foot supporting implement, and is conformable to the shape of a region of the foot or footwear against which it may be forcibly tightened about. A fastener, having an entrance for receiving an end of the engagement member, includes a guide element located forwardly and upwardly of the entrance.

In another illustrative embodiment, a strap sub-assembly that is mountable to a foot supporting implement, such as an article of footwear or a footwear binding, is provided. The strap sub-assembly can cooperate with a separate engagement member to provide a variable length strap for engaging at least a portion of the foot or footwear. The sub-assembly includes a first stiff elongated strap having a portion thereof that is constructed and arranged for mounting to the foot supporting implement, and is conformable to the shape of a region of the foot or footwear against which it may be forcibly tightened about. A fastener, having a frame, is constructed and arranged to secure the stiff engagement member at various locations along the length thereof. A flexible hinge member is connected at a first end to the first stiff elongated strap, has a portion passing through an opening in the frame, and is connected at a second end to the first stiff elongated strap. The fastener is flexibly mounted to said first stiff elongated strap by the flexible hinge member so that said fastener is moveable independent of said first stiff elongated strap in at least two degrees of freedom, facilitating introduction of said stiff engagement member to said fastener.

BRIEF DESCRIPTION OF THE DRAWINGS

It should be understood that the drawings are provided for the purpose of illustration only and are not intended to define the limits of the invention. Various aspects of the present invention will become apparent with reference to the following detailed description taken in conjunction with the accompanying drawings in which.

DETAILED DESCRIPTION

Figure 1:
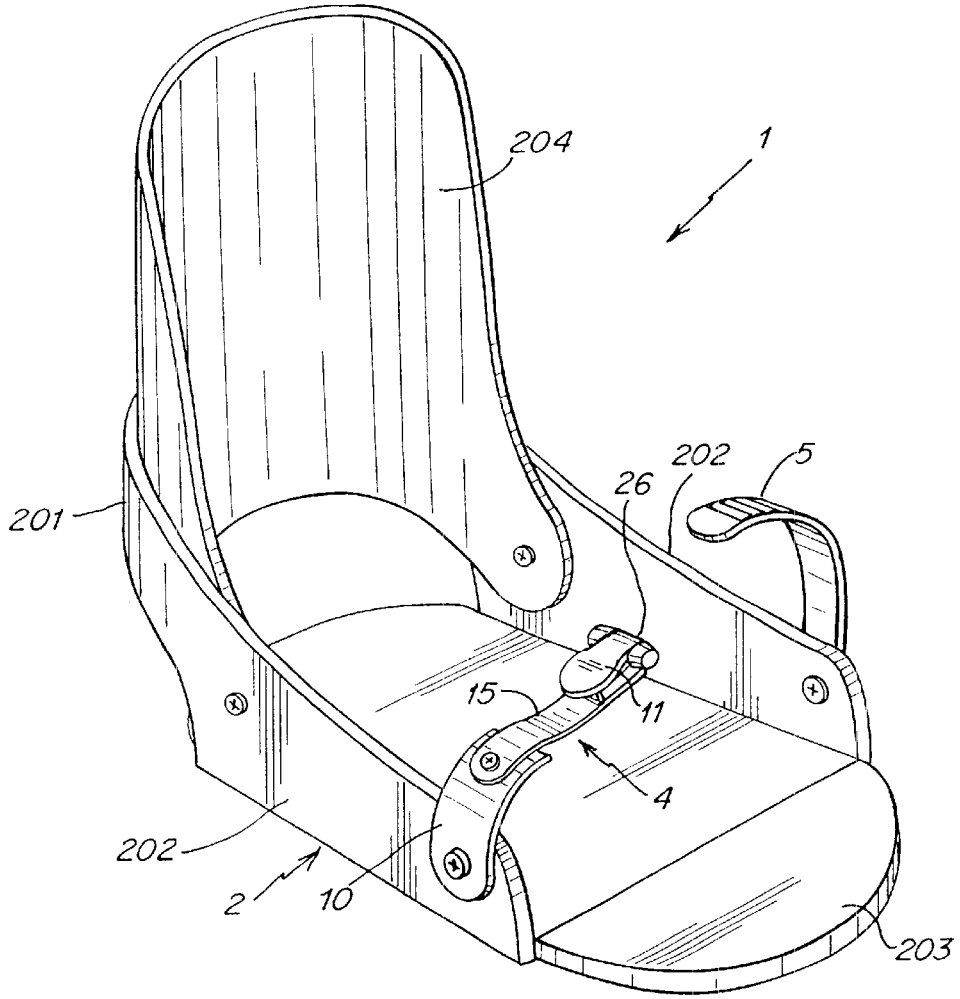
FIG. 1 is a perspective view of a snowboard binding having a fastening assembly in an illustrative embodiment of the invention.

A fastening assembly is provided having improved handling characteristics to allow, for example, a rider to more easily introduce an engagement member into, or mate with, a fastener. In one illustrative embodiment, the fastener may be secured to a strap portion, or other substrate, so that the fastener may be moved relatively independently of the strap portion (or other substrate), thereby allowing alignment of the fastener with the engagement member. The term "moved relatively independently" refers to movement of a fastener relative to a strap portion or other binding portion in at least one degree of freedom such that the fastener may be moved more than a minimal amount (e.g., greater than 5 mm) without requiring movement, or substantial movement, of the strap portion or other substrate. The engagement member may be another portion of a binding strap or other fitting that engages with the fastener. The ability to move the fastener relatively independently of the strap portion may provide an advantage, particularly to younger or less dextrous riders, since less strength and/or dexterity may be required to operate the fastening assembly. For example, by allowing the fastener to be aligned with the engagement member without requiring substantial movement of the strap portion (or other substrate), there may be no need to physically move and position a potentially stiff and/or improperly positioned strap portion to allow introduction of the engagement member to the fastener.

In one illustrative embodiment, a fastening assembly may have two opposed strap portions that may be joined together and tightened over a snowboard rider's foot. In this embodiment, a fastener is secured to a first strap portion and receives an engagement member that is part of a second strap portion. One or both of the first and second strap portions and/or the fastener may have improved handling characteristics to facilitate introduction of the engagement member to the fastener. For example, the fastener may be secured to the first strap portion to allow the fastener to be moved relatively independently of the first strap portion. For example, the fastener may include a buckle that is secured to the first strap portion by a hinge-type connection, e.g., a flexible webbing, so that the fastener may be moved relatively independently of the first strap portion. Thus, for example, the fastener may be raised, lowered, twisted or otherwise moved relative to the first strap portion to allow easier introduction of the second strap portion into the fastener. Since the fastener may be moved independently of the first strap portion, the second strap portion may be introduced into the fastener without requiring substantial movement of the first strap portion. The second strap portion may also include a hinge so that an end portion of the second strap portion may be moved relatively independently of the other part of the second strap portion. This feature may allow easy adjustment of the end portion's position and introduction into the fastener.

In another illustrative embodiment, a fastening assembly having improved handling characteristics may have a fastener attached to a strap portion, or other substrate, so that an entrance to the fastener where an engagement member is introduced to the fastener is accessible from a side of the fastener nearest the strap portion or other substrate. For example, the entrance to the fastener may be positioned forward of an end of the strap portion to which the fastener is attached so that an engagement member may be introduced to the fastener from a bottom side of the fastener, i.e., a side of the fastener nearest the strap portion. Snowboard binding straps typically have a fastener attached to a strap portion so that an entrance of the fastener is positioned behind an end of the strap portion to which the fastener is attached. Thus, introduction of an engagement member into an entrance of the fastener from a bottom side of the fastener may be blocked by the strap portion. In contrast to such binding straps, an illustrative embodiment of the invention has a fastener attached to a strap portion so that an engagement member may be introduced to the fastener entrance from any side of the fastener. For example, positioning of the fastener entrance forward of the strap portion end and/or using a hinge-type connection to attach the fastener may allow easier introduction of an engagement member to the fastener entrance, e.g., because the entrance position may be more easily viewed by a rider (allowing better feedback for adjustment of the entrance position by the rider), because the entrance may be better exposed for introduction of the engagement member, and/or because the rider may be able to introduce an engagement member into the entrance from below the fastener on the strap portion side (which may not be possible when the entrance is positioned behind the strap portion end).

In another illustrative embodiment, a fastening assembly having improved handling characteristics may have a fastener attached to a strap portion so that the fastener may be grasped in one hand without grasping the strap portion. This feature may allow a rider to more easily position the fastener for introduction of an engagement member to the fastener since the ability to grasp the fastener in one hand without the strap portion may give the rider a better grip on the fastener, and thus better ability to twist, lift or otherwise move the fastener to a desired position. Fastening assemblies on snowboard binding straps typically are attached to a strap portion so that a rider may not entirely grasp the fastener in one hand independently of the strap portion or other substrate, thereby potentially making it difficult to position the fastener in a suitable way for introduction of an engagement member to the fastener. The term "entirely grasp" is intended to refer to the ability to grasp an entire fastener in one hand, not just a part of the fastener.

In another illustrative embodiment, a fastening assembly may include one or more guide members to facilitate introduction of an engagement member to a fastener. The guide members may act to direct the engagement member into the fastener when the engagement member is misaligned or off target with respect to the fastener. In one illustrative embodiment, the guide member may act as a funnel to guide an engagement member end into an entrance of a fastener. For example, the guide member may guide a second strap end as it is being introduced into a buckle so that the end enters an entrance of the buckle without requiring a level of precise strap handling by a rider that might otherwise be required. The guide members may be arranged in any suitable way to facilitate introduction of the engagement member. For example, the guide members may be positioned forward of an entrance to the fastener to create an engagement member introduction area that is forward of, and larger than, the entrance of the fastener. The guide members may have sloped guide surfaces to guide the engagement member toward the entrance as the engagement member is moved toward the entrance. The guide members may be supported in any suitable way, such as attached to a fastener, a frame that also supports the fastener, a first strap portion to which the fastener is secured, and so on.

In one illustrative embodiment, a fastening assembly may include any two or more improved handling characteristics, such as one or more guide members and mounting of a fastener to a strap portion so that the fastener may be moved relatively independently of the strap portion. The combination of guide members and independent fastener movement may provide for eased introduction of an engagement member to the fastener since the fastener may be moved to suitably position the fastener relative to the engagement member, and the guide members may help guide the engagement member into engagement with the fastener. The fastener entrance may also be positioned so that the engagement member may be introduced from a bottom side of the fastener. The guide members may be positioned above the fastener entrance to "catch" the engagement member and guide it into the entrance when it is introduced from the bottom side. This combination of improved handling characteristics may be particularly useful for young riders that do not have the strength or dexterity to easily engage conventional binding strap assemblies together.

For example, a rider using the fastening assembly 4 on the binding 1 shown in the illustrative embodiment of FIG. 1 may grasp a fastener 11 in one hand and a second strap portion 5 in another hand. Since the fastener 11 may be attached to a first strap portion 10 by a hinge 15, the fastener 11 may be grasped in one hand without grasping the first strap portion and moved by the rider relatively independently of the first strap portion 10. That is, the fastener 11 may be raised, lowered, twisted or otherwise moved relative to the second strap portion 5 without requiring substantial movement of the first strap portion 10 since the hinge 15 may be made of, or include, a material, structure or device that allows relatively free movement of the fastener 11. Thus, the hinge 15 may allow the rider to position the fastener 11 in at least one, two and/or preferably three degrees of freedom so that the second strap portion 5 may be introduced to the fastener 11 for engagement with the fastener 11, e.g., the second strap portion 5 may be inserted into an entrance 26 of the fastener 11.

Figure 2:
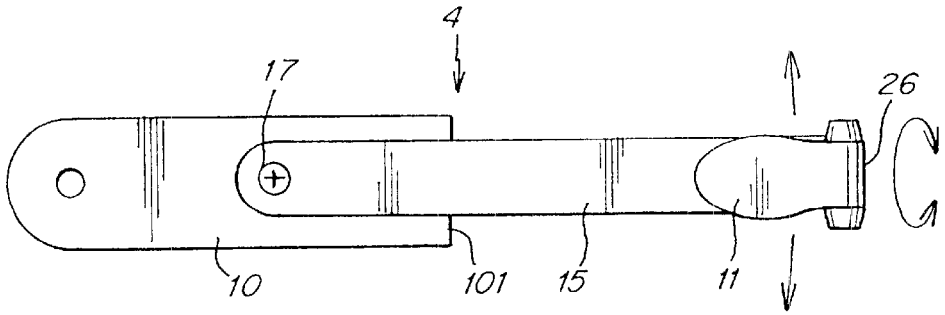
FIG. 2 is a plan view of the fastening assembly in the embodiment shown in FIG. 1.

FIG. 2 shows a schematic diagram of the first strap portion 10, hinge 15 and fastener 11 of the illustrative embodiment of FIG. 1. In this illustrative embodiment, the hinge 15 may include any suitable material, structure or device, e.g., a flexible element such as a piece of flexible webbing that is secured to the first strap portion 10, e.g., by a screw 17 or other suitable element (adhesive, stitching, rivets, and so on). The hinge 15 may additionally or alternately include any other suitable element to allow movement of the fastener 11 relative to the first strap portion 10 or other substrate, such as two or more hinge plates joined by a hinge pin, a living hinge or joint structure, one or more flexible wires, a ball and socket joint, etc.

In this illustrative embodiment, the fastener 11 is a ratchet-type buckle that engages with serrations on the second strap portion 5. However, it should be understood that the fastener 11 may be, or include, any suitable device (s), such as D-rings, a pawl mechanism, a hook or eye, or any other suitable clip, buckle or other device used to attach, preferably releasably, two items together as the invention is not limited in this regard. Similarly, the second strap portion 5, which acts as an engagement member to engage with the fastener 11, in this embodiment is a serrated strap, but the second strap portion 5 may include any suitable member, structure or device that may be introduced to and engaged with the fastener 11. In addition, the engagement member need not be a second strap portion 5, but may be replaced with any suitable feature or device on the binding 1, such as a tongue that is attached to or formed as part of the sidewall 202 of the binding 1. In this case, the fastener 11 may be engaged with the engagement member on the binding 1 to secure the rider's foot to the binding 1.

In this illustrative embodiment, the hinge 15 secures the fastener 11 to the first strap portion 10 so that the entrance 26 of the fastener 11 is positioned forward of an end 101 of the first strap portion 10. Thus, the second strap portion 5 may be introduced to the entrance 26 of the fastener 11 from below the fastener 11, i.e., from the side of the fastener 11 that is attached to the hinge 15 in this embodiment. This ability may provide a more natural way to introduce the second strap portion 5 into the entrance 26 because of the movement of the fastener 11 and second strap portion 5 that may be required to allow a rider's foot to be placed in the binding 1. For example, once the second strap portion 5 and fastener 11 are moved apart to allow a rider to place a foot in place in the binding 1, the second strap portion 5 and fastener 11 may be moved together by approximately rotating the end of the second strap portion 5 around an attachment point of the strap portion 5 to the binding base 2 and approximately rotating the fastener 11 around the attachment point of the hinge 15 to the first strap portion 10 (e.g., the screw 17). Since the fastener 11 and the end of the second strap portion 5 are moved in an approximately rotary fashion toward each other, it may be more natural for the rider to introduce the second strap portion 5 to the entrance 26 from a bottom side of the fastener 11. This is in contrast to typical snowboard binding straps in which a fastener is positioned directly over a first strap portion, thereby blocking introduction of the second strap portion from a bottom side of the fastener. Since the end of the first strap portion blocks the entrance from the bottom side, a rider may be required to bend the end of the second strap portion around an end of the first strap portion to insert the second strap portion into the fastener.

As another feature of this illustrative embodiment, the fastener 11 may be positioned so that a rider may entirely grasp the fastener 11 in one hand without grasping the first strap portion 10. (By "entirely grasp" it is meant that the entire fastener 11 may be grasped in one hand, not just a portion of the fastener 11, such as a ratchet buckle handle.) This feature may allow a rider to more easily position the fastener 11 in a desired way because the rider may obtain a better grip on the fastener 11. This is in contrast to typical snowboard binding straps which have a fastener 11 attached to a first strap portion so that the fastener 11 may not be grasped without also grasping the first strap portion. This typical arrangement may make it difficult for some riders to grasp and manipulate the fastener, such as those riders with small hands that may not be able to obtain a good grip on the fastener.

It should be understood that these improved handling characteristics need not all be used together in a strap assembly 4. For example, the hinge 15 may be omitted and the fastener 11 attached to the first strap portion 10 so that the entrance 26 is positioned forward of the strap end 101. Alternately, the hinge 15 may be used and the entrance 26 positioned rearward of the end 101. Similarly, the hinge 15 may be omitted and the fastener 11 attached to the first strap portion 10 so that the fastener 11 may be grasped in one hand without the first strap portion 10. For example, the fastener 11 may be attached to the first strap portion 10 by a rigid extension of a base or frame of the fastener 11 that extends rearwardly from the fastener 11. Thus, various different combinations of improved handling characteristics described herein may be used together.

FIG. 1 shows this illustrative embodiment of a fastening assembly 4 attached to a binding 1 for a snowboard, but the fastening assembly may be used with other types of bindings or fastening applications, such as in snowshoes, surfboards, wakeboards, etc. In this embodiment, the binding 1 has a binding base 2 that may be attached to a snowboard or other gliding apparatus (not shown). The base 2 may be attached to the snowboard or other gliding apparatus in any suitable way, as the invention is not limited in this regard. For example, the base 2 may be attached to a snowboard by one or more screws, a hold-down disk, adhesive, and so on. In addition, the base 2 in this example may have well-known features such as a heel loop 201, sidewalls 202, a toe pad 203, and a highback 204, but these features are optional. For example, the binding 1 may only include sidewalls 202 that are separate from each other and attached to a snowboard. The binding 1 may include other known features not shown, such as runaway straps and so on, as the invention is not limited in this regard.

In this illustrative embodiment, the strap assembly 4 has two strap portions, a second strap 5 and a first strap 10, that are each mounted to opposite sidewalls 202 and may be united together to secure a toe portion of a rider's foot to the base 2. Although illustrated as a toe strap, the invention is not so limited, and the strap assembly 4 may be embodied as an ankle strap, a shin strap, an instep strap, any combination thereof and such other binding strap arrangements as would be apparent to one of skill in the art. The strap portions 5 and/or 10 may have padding or cushioning material on various portions, and may be made of any suitable material or combinations of materials, such as metal, plastic, composite materials, and so on. The invention is not limited by the location or and the method of attachment of the straps to the binding base 2 or snowboard.

As discussed above, another aspect of the invention provides guide members to facilitate introduction of an engagement member to a fastener. Guide members 21 are shown in an illustrative embodiment of the invention in FIG. 3. In this embodiment, the guide members 21 are positioned forward of an entrance 26 of the fastener 11 to help guide an end of the second strap portion 5 (the engagement member in this embodiment) into the entrance 26. Thus, when a rider introduces the second strap portion 5 into the entrance 26, the guide members 21 may contact the end of the strap portion 5 and guide the end toward the entrance 26. An upper guide member 21A may be provided along an upper side, i.e., a side opposite the first strap portion 10, forward of the entrance 26. Thus, if the second strap portion 5 is introduced from a bottom side of the entrance 26, the upper guide member 21 A may contact the second strap portion 5 to prevent it from moving too far above the entrance 26. Lateral guide members 21B and 21C may be provided on lateral sides of the entrance 26 to laterally guide the second strap portion 5 toward the entrance 26.

The guide members 21 may have any suitable shape, size, construction, and so on, to provide desired strap handling characteristics. For example, the guide members 21 may include flared, slanted, angled or inclined surfaces so that the guide members act as a kind of funnel to guide the second strap portion 5 toward the entrance 26. Thus, the guide members 21 may define an introduction area forward of the entrance 26 that is larger than the entrance area. The larger introduction area may provide for eased introduction of the strap portion 5 to the fastener 11 since less accuracy may be required to introduce the strap portion 5 into the introduction area and thus into the entrance 26. As the strap portion 5 is introduced further toward the entrance 26, the size of the introduction area defined by the guide members 21 may decrease, approaching the entrance area size. Although three or more guide members 21 are shown in this illustrative embodiment, fewer guide members 21 may be provided, and the arrangement of the guide members 21 may be suitably varied to accommodate the introduction of different engagement members and fasteners 11. The guide members 21 may be supported forward of the entrance 26 of the fastener 11 in any suitable way. In this illustrative embodiment, the guide members 21 are formed as part of a frame 12 to which the fastener 11 is attached. However, the guide members 21 may be attached to the fastener 11, the first strap portion 10, the hinge 15 or any other suitable element.

Figure 3:
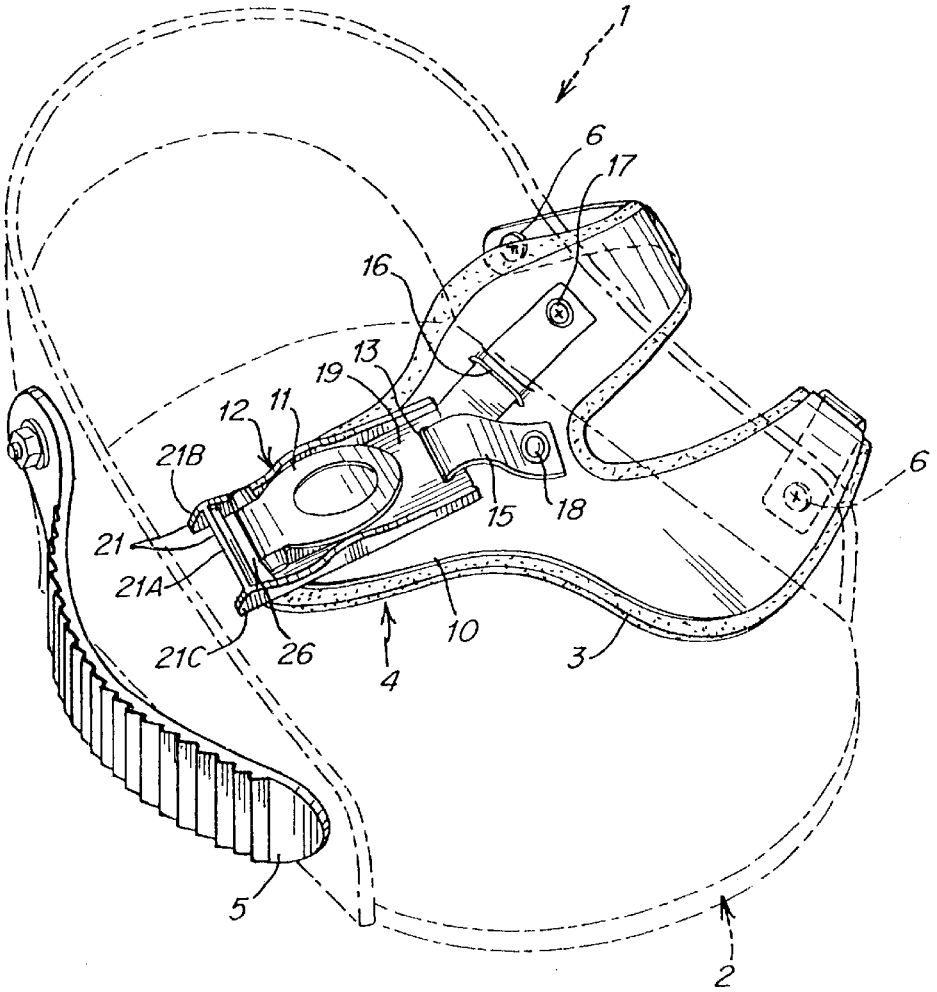
FIG. 3 is a perspective view of a snowboard binding having a fastening assembly according to another illustrative embodiment of the invention.
Figure 4:
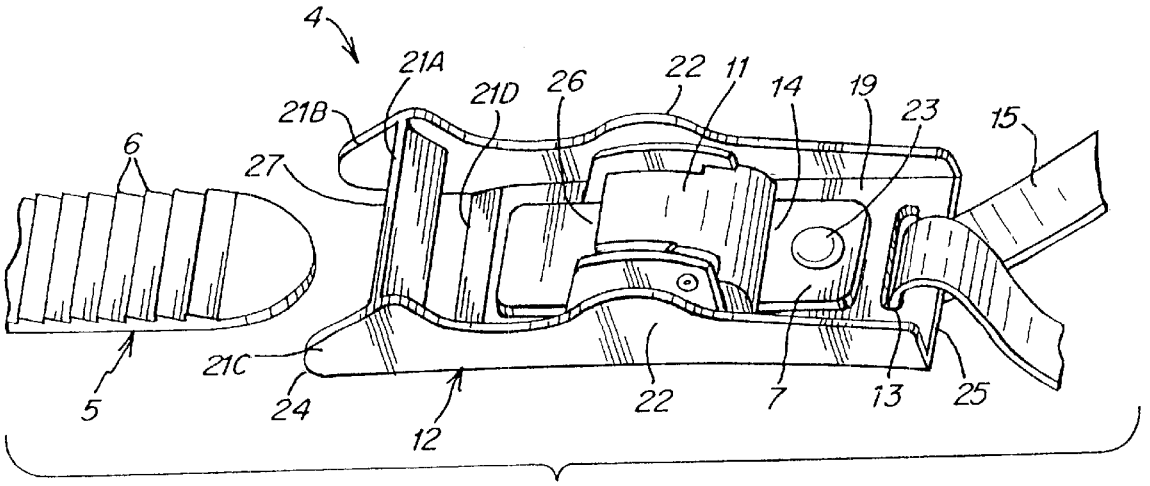
FIG. 4 is a top perspective view of an illustrative embodiment of a fastening assembly having a guide member.

Another illustrative embodiment showing how the guide members 21 may be arranged is shown in FIG. 4. This embodiment is similar to that shown in FIG. 3 in that the upper guide member 21A, two lateral guide members 21B and 21C, and a lower guide member 21D (not shown in FIG. 3) are supported by a front end 24 of the frame 12. The guide members 21A–21D are positioned forward of the fastener entrance 26 to help direct the second strap portion 5 into the entrance 26. The upper guide member 21A may be an elongated rectangular bar that extends between the two lateral guide members 21B and 21C and may be positioned so that a leading face, or guide surface 27, of the upper guide member 21A that may be contacted by the second strap portion 5 as it is inserted into the entrance 26 is angled toward the entrance 26. Of course, the upper guide member 21A, as well as the other guide members 21, may have other shapes and present other suitable guide surfaces. In this embodiment, the lateral guide members 21B and 21C flare outwardly, i.e., the distance between the two lateral guide members 21B and 21C is greater at the front end 24 of the frame 12 than at a portion nearer the entrance 26. Thus, guide surfaces of the lateral guide members 21B and 21C may also be angled toward the entrance 26. The lower guide member 21D may be an inclined portion of a leading edge of the frame base 19, and may extend below the base 19. The lower guide member 21D may extend forward of the entrance 26 any suitable amount, e.g., to help prevent the second strap 5 from passing through an opening between the upper guide member 21A and the entrance 26 to the fastener 11. For example, if an opening is provided between the upper guide member 21A and the entrance 26 as shown in FIG. 4, the lower guide member 21D may be configured (e.g., extended forward of the entrance 26) to help prevent the second strap portion 5 from passing through the opening and not into the entrance 26 when the second strap portion 5 is introduced from a bottom side of the fastener 11. The lower guide member 21D may also not extend as far forward of the entrance 26 as the upper guide member 21A and/or the lateral guide members 21B and 21C to allow introduction of the second strap portion 5 from a bottom side of the fastener 11.

The illustrative embodiment shown in FIG. 4 also includes a fastener 11 attached to a base 19 of the frame 12. The frame 12 may be shaped to provide an effective gripping arrangement for a rider, e.g., so the rider may easily hold and manipulate the fastener 11. The fastener 11 may have a mount 7 that is attached to the base 19 by any suitable means, such as a rivet 23, adhesive, a screw or other. The frame 12 may have two sidewalls 22 that extend upwardly from the base 19. The frame 12 extends rearwardly from near a fastener exit 14 to a rear end 25, and extends forwardly from near the fastener entrance 26 to the front end 24. A hinge 15 may engage with a slot 13 in the base 19 near the rear end 25 to secure the frame 12 to a first strap portion 10 or other binding portion. Alternately, the frame 12 may be directly attached to the first strap portion 10, e.g., by a screw fastening the frame 12 at the slot 13 to the strap portion 10.

Figure 5:
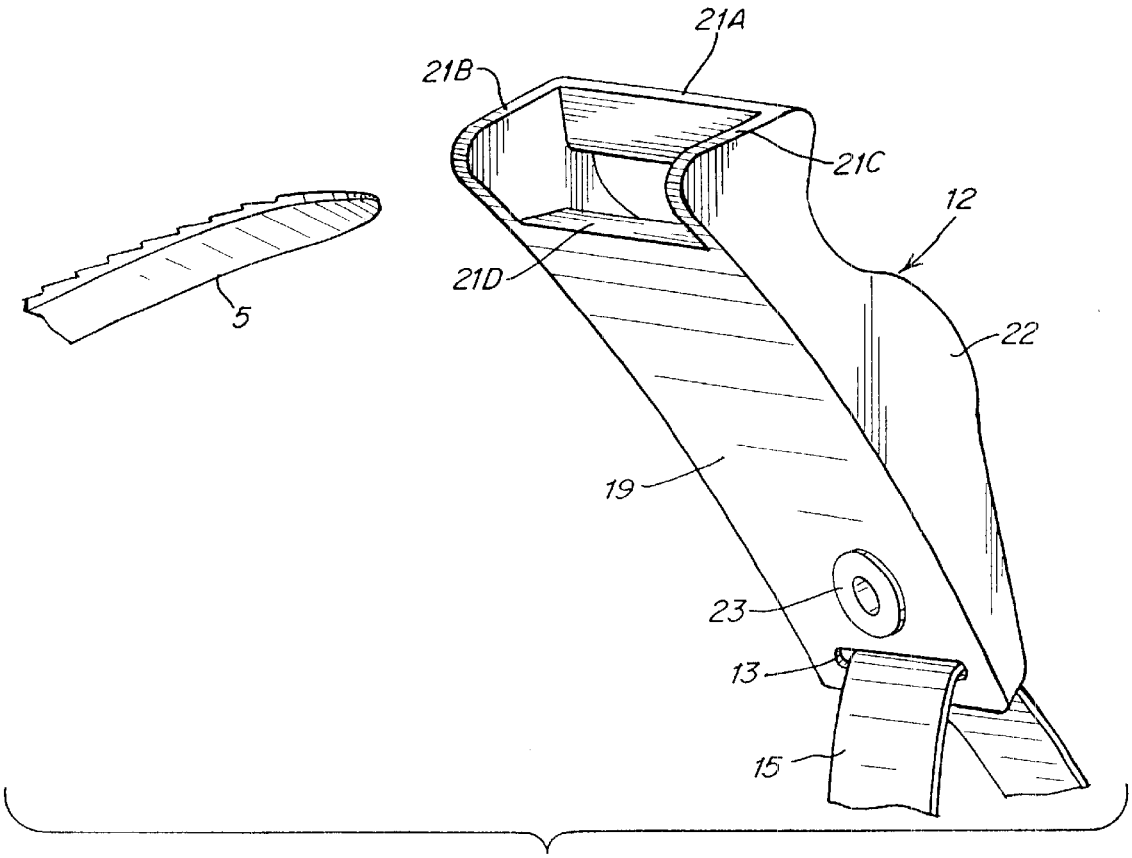
FIG. 5 is a bottom perspective view of the illustrative embodiment of FIG. 4.

FIG. 5 is a perspective view from below of the frame 12 and of the second strap portion 5 shown in FIG. 4. As shown in this illustrative embodiment, the lower guide member 21D may be positioned rearwardly closer to the entrance 26 than the upper guide member 21A. This relative positioning of the upper and lower guide members 21A and 21D may create an enlarged region, e.g., formed by the upper and lateral guide members 21A–21C extending out further than the lower guide member 21D, where the second strap 5 may be "caught" and guided by the guide members 21, thereby potentially requiring less precision when introducing the second strap 5 into the fastener 11. Thus, the second strap 5 may be introduced to the entrance 26 from below the frame 12 and the fastener 11 and made to contact the upper guide member 21A (and potentially one or more of the lateral guide members 21B and 21C) and guided into the entrance 26. This contact may also help to orient the fastener 11 properly relative to the second strap 5, e.g., contact of the second strap 5 with the upper guide member 21A may cause the upper guide member 21A to lie flat across the serrated surface of the second strap 5, causing the frame 12 and fastener 11 to properly orient themselves with respect to the second strap 5.

Introducing the second strap portion 5 from a bottom side of the fastener 11 may provide a more natural way for a rider to introduce an engagement member to a fastener 11. For example, a rider may grasp the frame 12 and fastener 11 in one hand, grasp the second strap portion 5 in the other hand, align the second strap portion 5 and the fastener 11, and move the frame 12 and fastener 11 down on the end of the second strap portion 5. The end of the second strap portion 5 may be caught by the guide members 21 and guided toward the entrance 26. Thus, an arrangement that includes guide members 21 such as those shown in FIGS. 4 and 5 may facilitate introduction of the second strap portion 5 with the fastener 11 since the second strap portion 5 and the fastener 11 need not be accurately moved together along a linear path to insert the second strap portion 5 into the entrance 26 of the fastener 11 (as may be the case in conventional snowboard binding straps). Instead, the fastener 11 may be rotated or otherwise moved in a direction transverse to the end of the second strap portion 5 until the end of the second strap portion 5 is caught by the guide members 21. Once the end is caught by the guide members 21, the fastener 11 and second strap portion 5 may be moved toward each other with the guide members 21 directing the strap end into the entrance 26.

Figure 6:
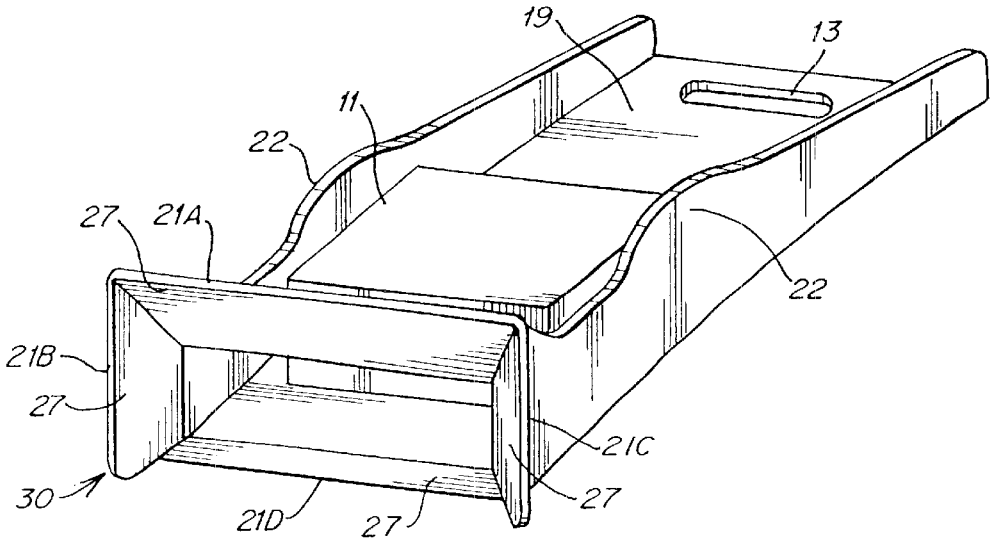
FIG. 6 is a top perspective view of another illustrative embodiment of a strap fastening assembly having a funnel-type guide member.

As discussed above, any suitable configuration may be used for the guide members 21. For example, FIG. 6 shows an illustrative embodiment in which a frame 12 includes a different type of funnel 30 in which guide surfaces 27 of the upper, lateral and lower guide members 21A–21D are joined together and the lower guide member 21D does not extend as far from the entrance 26 as the other guide members 21A–21C. Rather than having four relatively straight guide surfaces 27 of the guide members 21 joined together as shown in FIG. 6, the funnel 30 may have one guide surface 27 that is continuous and non-linear and circumscribes, or partially circumscribes, an introduction area forward of the entrance 26. Thus, the funnel 30 may define a guide surface 27 that is concave and frusto-conical, or partially frusto-conical for inserting a strap into the entrance 26 of a fastener 11.

Figure 7:
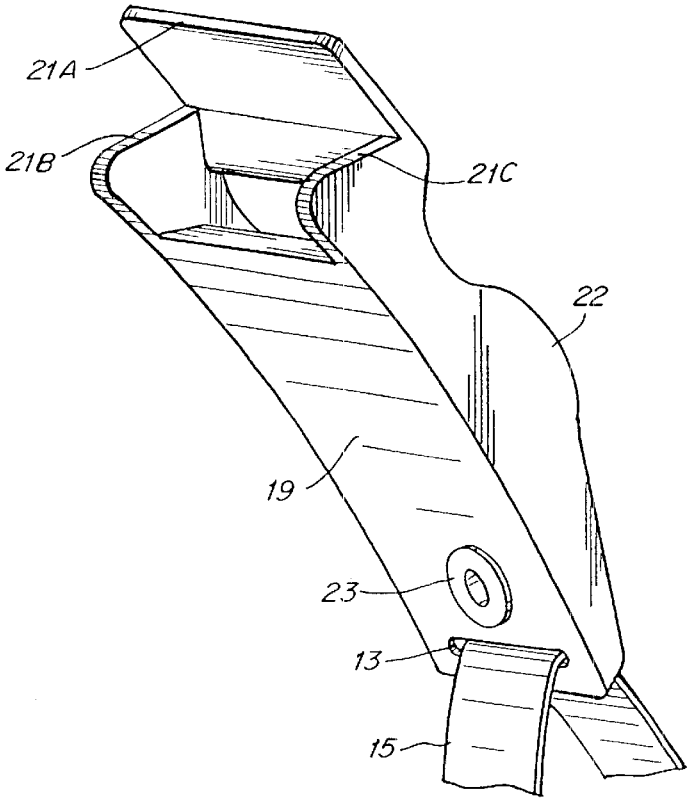
FIG. 7 is a top perspective view of another illustrative embodiment of a strap fastening assembly with an enlarged upper guide member.
Figure 8:
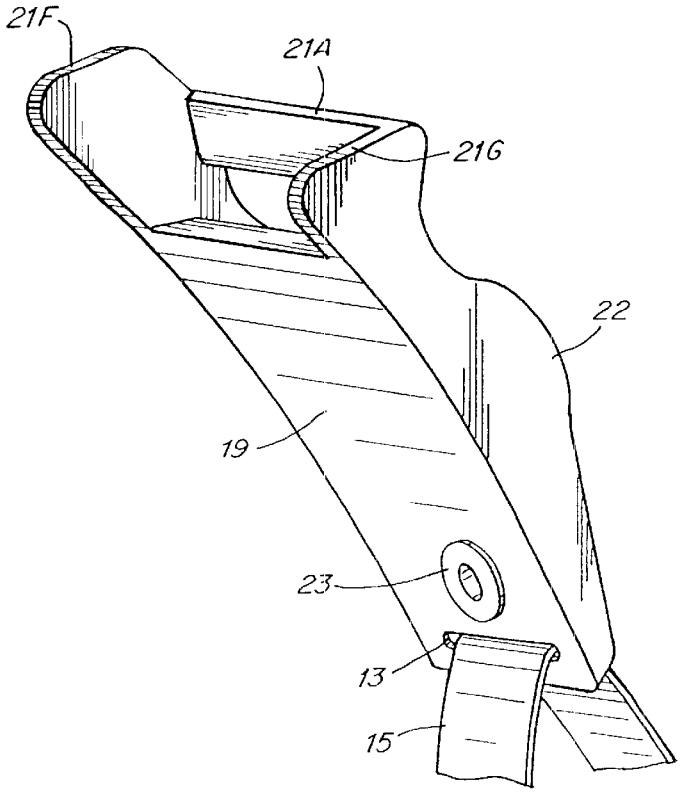
FIG. 8 is a top perspective view of another illustrative embodiment of a strap fastening assembly with an enlarged lateral guide member.

FIG. 7 shows an illustrative embodiment in which the length of an upper guide member 21A may be extended forward from the fastener 11 to provide a larger area of blocking or guiding. This illustrative embodiment may be useful for introducing an engagement member from below the fastener 11 as discussed above. In another illustrative embodiment shown in FIG. 8, one lateral guide member 21F may extend further forward than the opposing lateral guide member 21G to allow the second strap portion 5 to be inserted from one side of the fastener 11. This illustrative arrangement may be useful for facilitating introduction of an engagement member from a side of the fastener 11, which may be a more natural direction in some applications. Additionally, the lateral guide member 21G may be omitted to allow unobstructed access from one side of the fastener 11. Of course, as with any of the aspects of the invention described herein, the guide members 21A and 21F from the embodiments shown in FIGS. 7 and 8 may be combined together in a single device.

Figure 9:
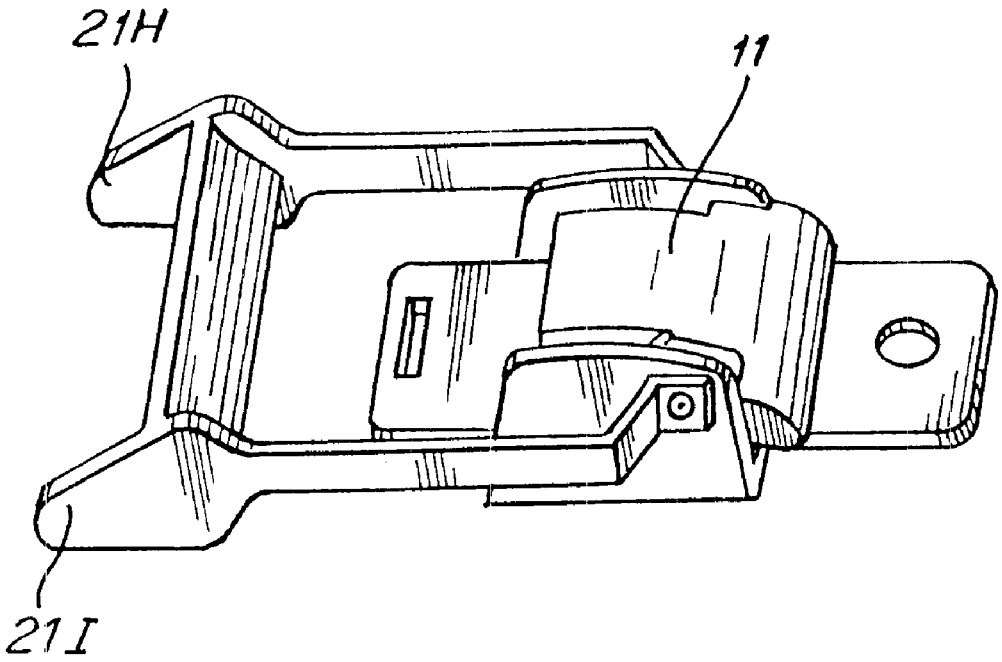
FIG. 9 is a top perspective view of another illustrative embodiment of a strap fastening assembly with guide members directly attached to a fastener.

The illustrative embodiments shown above include guide members 21 that are supported by a frame 12, but the guide members 21 may be supported in any suitable way. In another illustrative embodiment shown in FIG. 9, guide members 21H and 21I are attached directly to a fastener 11 and may be suitable when a frame 12 is not used. As discussed above, the guide members 21 may be attached to a strap portion to which the fastener 11 is attached or any other suitable element. Other configurations and arrangements for the guide members 21 may be employed as will be apparent to those of skill in the art.

As discussed above, guide members may, or may not, be used with any other improved handling characteristics mentioned above. For example, the arrangement shown in FIG. 3 may allow a rider to grasp the frame 12 and fastener 11 in one hand and move the frame 12/fastener 11 relatively independently of the first strap, i.e., with little or no substantial movement of the first strap 10. Of course, the first strap 10 may still be made movable if sufficient force is applied, either directly to the strap 10, the hinge 15 or the frame 12. Thus, the fastener 11 may be positioned relative to the first strap 10 without having to move any portion of the first strap 10. This feature may be advantageous, e.g., if the first strap is made of a relatively stiff material that is difficult to bend and precisely position when engaging the first and second straps 5 and 10, especially for a child.

In the illustrative embodiment shown in FIG. 3, the fastener 11 is attached to the first strap portion 10 by a hinge 15 that may be a portion of flexible webbing attached to the first strap portion 10 at one end, e.g., by a screw 17 or other suitable element. The hinge 15 may pass through a slot 13 in the frame 12, and be secured at a second end to the first strap portion 10, e.g., by a rivet 18 or other suitable fastener. The hinge 15 may also pass through a guide loop 16 attached to the first strap portion 10. The guide loop 16 may provide a means to limit the range of movement of the fastener 11 relative to the first strap 10, and may be integrally formed with the first strap 10. Alternately, the optional guide loop 16 may be formed of any suitable material and attached to the first strap 10, or may be formed as a hook or incomplete loop, rather than a complete loop. The hinge 15 may be removably attached to the first strap 10 so that the fastener 11 may be removed and/or so that the position of the fastener 11 may be adjusted relative to the first strap portion 10, e.g., by changing the position where the screw 17 engages the first strap 10. In addition, the guide loop 16 may be eliminated and/or the hinge 15 may be attached to the first strap 10 at only one point, rather than two.

As in the illustrative embodiment shown in FIG. 1, the hinge 15 may be, or include, a ball and socket joint, a hinge joint or other suitable device instead of a flexible webbing. In another embodiment, a portion of the frame 12 or the fastener 11 may be directly attached to the first strap 10 so that the entrance 26 is positioned forward of the end of the first strap 10. In yet another embodiment, the first strap 10 may include joints, hinges, multiple strap portions of different stiffnesses, flexible strap sections, or other structure, material or devices interconnecting the strap portions to allow the fastener 11 to be easily manipulated. The fastener 11 or the frame 12 may be directly attached to the base 2, and a hinge 15 may be provided as part of the second strap portion 5, e.g., a hinge 15 may be positioned at some point along the second strap portion 5 to allow the end of the second strap 5 that is inserted into the fastener 11 to be moved independently of the other part of the second strap portion 5. In another embodiment, the second strap portion 5 may be replaced with a tab or other engagement member formed in or fixed to the base 2 that engages with the fastener 11. In this case, the fastener 11 or some other portion of the first strap portion 10 may function to tighten the first strap portion 10 around the rider's foot.

As mentioned above, the fastener 11 may be raised, lowered, twisted or otherwise moved relative to the first strap 10 and/or the binding base 2 without requiring movement, or substantial movement, of the first strap portion 10 or a portion of the base 2. Movement of the fastener 11 may be unlimited, e.g., the fastener 11 may be movable in any suitable number of degrees of freedom in any amount, or may be limited, e.g., the fastener 11 may be movable in only one, two or three degrees of freedom or may be movable only within a certain range relative to the first strap portion 10. Movement of the fastener 11 may be limited by the hinge 15 or other suitable means. For example, the hinge 15 may include elements that bias or hold the fastener 11 in one or more directions or positions. For example, a rotary spring or other suitable element may be included with the hinge 15 to bias the fastener 11 to rotate in an upward direction, e.g., away from a rider's foot. Similarly, a spring or other suitable element may be provided to bias the fastener 11 in one or more other directions relative to the first strap 10, e.g., to bias the fastener 11 toward a toe end of a binding base 2. The fastening assembly 4 may include one or more detent mechanisms or similar devices that are part of, or act as, the hinge 15 so that the fastener 11 may be moved to one or more positions and held in place by the detent. For example, a detent may be provided so that the fastener 11 may be rotated and held in any one of a number of angular positions relative to the first strap portion 10. Thus, for example, a rider may position the fastener 11 at a desired position and the detent may hold the fastener 11 at that position even if the rider lets go of the fastener 11 (provided, of course, that no force great enough to overcome the retaining force of the detent is applied to the fastener 11).

In this illustrative embodiment, the first strap 10 has a Y-shape and has two binding base attachment points 6. However, the strap 10 may have one, or more than two, attachments points 6 and may be formed in any appropriate size or shape. The first strap 10 may also be a single, elongated strap with a single attachment point 6, similar to that shown in FIG. 1. Padding or cushioning material 3 may be added to the strap assembly 4 and the strap assembly 4 may be contoured or otherwise suitably shaped or configured to conform to a boot. In another embodiment, the second strap portion 5 may be replaced with a tab or other engagement member that is formed as part of, or otherwise attached to, the binding 1 that engages with the fastener 11. It should be understood, however, that the first and/or second strap portions 10 and 5 may have other shapes, such as a rod shape or any other suitable shape, and/or may include any suitable number of elements, e.g., the strap portions 5 and 10 may be a lamination or other combination of elements. In addition, the first strap portion 10 may be eliminated and the hinge 15 attached directly to the binding base 2, or the second strap 5 may be eliminated and the fastener 11 engaged with a feature formed in the base 2 or attached to the base 2.

In this illustrative embodiment, the fastener 11 may be a pawl mechanism as shown, or any other suitable fastening device or mechanism, such as a ratchet-type buckle, a hook, a clamp, a clasp, a clip, a hook and loop fastener, and so on. In this embodiment, the entrance 26 of the fastener 11 is located at a point on the fastener 11 nearest the second strap portion 5, but the entrance 26 may be located anywhere on or around fastener 11 depending on the method or location of engagement between second strap portion 5 and the fastener 11. Also, the second strap portion 5 is serrated on one side so that it may engage with the fastener 11, but any type of strap or device having suitable features may be used so that the second strap portion 5 may engage with the fastener 11. For example, the second strap 5 may be serrated along its edges or include an attached fastening component, such as a ring or grommet, that engages with fastener 11. The second strap portion 5 may be made of any durable material, such as plastic or metal, and may be constructed to have variable thickness, width, or rigidity throughout its length. The leading tip of the strap 5 may be tapered, pointed, or have a blunt end. Other modifications may be used as will be apparent to one of skill in the art.

Similar to the embodiment of FIG. 1, the binding 1 is adapted to be attached to a snowboard or other gliding apparatus (not shown). The method or structure of the binding base 2 attachment to the snowboard is not of importance to the invention. Therefore, screws, a hold-down disk or other suitable means may be used to attach the binding base 2 to a gliding apparatus. A single strap assembly 4 for securing a boot (not shown) is attached to the binding base 2, but two or more separate straps assemblies 4 may be provided on the binding base 2. For example, the binding base 2 may include a toe strap, an ankle strap, a shin strap, or an instep strap. Any type of binding configuration known in the art may be used, e.g., the binding base 2 may be eliminated and the strap assembly 4 may be attached directly to a snowboard.

Combined in a single assembly, the guide members 21 and the hinge 15 may allow for eased introduction of the second strap 5 into the fastener entrance 26. The hinge 15 may allow the fastener 11 to be oriented or positioned such that it is more convenient to direct the second strap 5 into the entrance 26. The guide members 21 may provide a larger or more convenient area to guide the second strap 5 into engagement with the fastener 11. The frame 12, guide members 21 and the flexibility of the fastener attachment, e.g., the hinge 15, may be used in conjunction with each other as part of a strap fastening assembly 4, or each feature may be used alone to provide eased insertion characteristics. The combination may allow the rider to grasp the fastener 11 and/or the first strap 10 in one hand, grasp the opposing second strap 5 in the other hand, and roughly align the two by freely moving the fastener 11 and/or the second strap 5 end. As the second strap 5 and fastener 11 are brought toward each other, the guide members 21 may help direct the second strap 5 into the fastener entrance 26.

Although the strap fastening assembly 4 has been described in connection with a snowboard binding, it is to be appreciated that the strap fastening assembly of the present invention may also be used on other footwear, such as snowboard boots, ski boots, snowshoes, in-line skates and the like, to provide the wearer of such footwear the convenience and advantages of the various aspects of the invention. The strap fastening assembly 4 may also be used in conjunction with a strap for binding or lashing down loads, such as securing a load to a vehicle roof and the like. It should be understood that relative orientation adjectives (such as upper, lower, bottom, side, etc.) have been used to simplify the present description and are not intended to limit the orientation of the strap fastening assembly 4 when mounted to a snowboard binding or other apparatus.

Having described particular embodiments of the invention in detail, various modifications and improvements will readily occur to those skilled in the art. Such modifications and improvements are intended to be part of this disclosure and within the spirit and scope of the invention. Accordingly, the foregoing description is by way of example only and the invention is defined by the following claims and their equivalents.

What is claimed is:

1. A snowboard binding system for securing a snowboard boot to a snowboard, comprising:

a base constructed and arranged to receive the snowboard boot and adapted for mounting to the snowboard;

a heel hoop attached to the base;

a highback for supporting the rear of the rider's leg that projects upwardly beyond the heel hoop;

a snowboard boot binding strap portion that extends from the base and is flexible and conformable to the shape of a region of the snowboard boot against which it may be forcibly tightened about;

a snowboard boot binding engagement member that extends from the base; and a hand holdable fastener mounted to the strap portion and arranged to secure the engagement member to cooperatively form a variable length binding member extending across the opening;

wherein the fastener is free to move in at least two degrees of freedom relative to the strap portion to which it is mounted.

2. The system of claim 1, further comprising:

a hinge-type connection that interconnects the hand holdable fastener and the strap portion.

3. The system of claim 2, wherein the hinge-type connection includes a flexible webbing.

4. The system of claim 1, wherein the hand holdable fastener is adapted to engage with the engagement member at various locations along a length of the engagement member.

5. The system of claim 1, wherein the hand holdable fastener has an entrance and wherein the hand holdable fastener is mounted to the strap portion to allow the engagement member to be introduced to the entrance from a bottom side of the entrance.

6. The system of claim 1, further comprising:

at least one guide member adapted to guide the engagement member into an entrance of the fastener.

7. The system of claim 1, wherein the hand holdable fastener is attached to the strap portion so that an entrance of the fastener is positioned beyond an end of the strap portion.

8. The system of claim 1, wherein the fastener is attached to the strap portion so that the fastener may be entirely grasped in one hand without grasping the strap portion.

9. The system of claim 1, further comprising:

a hinge-type arrangement that interconnects the hand holdable fastener and the strap portion.

10. The system of claim 9, further comprising:

at least one guide member supported forward of an entrance of the hand holdable fastener adapted to guide the engagement member toward the entrance.

11. The system of claim 1, wherein the binding strap portion is constructed and arranged to extend across a midline of the snowboard boot that extends in the heel-to-toe direction along the top surface of the snowboard boot.

12. A snowboard binding system for securing a snowboard boot to a snowboard, comprising:

a base constructed and arranged to receive the snowboard boot and adapted for mounting to the snowboard;

a heel hoop attached to the base;

a highback for supporting the rear of the rider's leg that projects upwardly beyond the heel hoop;

a strap that extends from the base, the strap being flexible and conformable to the shape of a region of the snowboard boot against which it may be forcibly tightened about;

an engagement member that extends from the base;

a hinge-type connection attached to the strap; and a fastener attached to the hinge-type connection having an entrance for receiving an end of an engagement member;

wherein the hinge-type connection is not required for operation of the fastener to engage with the engagement member.

13. The system of claim 12, wherein the fastener is adjustable in position relative to the strap in at least two degrees of freedom.

14. The system of claim 12, wherein the hinge-type connection includes a flexible webbing.

15. The system of claim 14, further comprising a guide loop attached to the strap, wherein the flexible webbing passes through the guide loop.

16. The system of claim 15, further comprising a frame having a slot, wherein the fastener is attached to the frame and the flexible webbing passes through the slot in the frame.

17. The system of claim 14, wherein the flexible webbing is attached to the strap at at least two positions.

18. The system of claim 12, wherein the strap is constructed and arranged to extend across a midline of the snowboard boot that extends in the heel-to-toe direction along the top surface of the snowboard boot.

19. The system of claim 12, wherein the fastener comprises a fastener entrance, the system further comprising:

at least one guide member positioned forwardly and upwardly of the fastener entrance.

20. The system of claim 19, wherein the at least one guide member is attached directly to the fastener.

21. The system of claim 19, further comprising a frame wherein the fastener is attached to the frame, and wherein the at least one guide member is attached to the frame.

22. The system of claim 19, wherein the at least one guide member has an inclined surface relative to the fastener.

23. The system of claim 12, wherein the fastener includes an entrance and the fastener is adapted to be positioned so that the entrance is beyond an end of the strap.

24. The system of claim 12, wherein the fastener is adapted to be grasped in one hand without grasping the strap.

25. A snowboard binding system for securing a snowboard boot to a snowboard, comprising:

a base constructed and arranged to receive the snowboard boot and adapted for mounting to the snowboard;

a heel hoop attached to the base;

a highback for supporting the rear of the rider's leg that projects upwardly beyond the heel hoop;

a first strap portion secured relative to the base and conformable to the shape of a region of the snowboard boot against which it may be forcibly tightened about, and extendable across a midline of the snowboard boot that extends in the heel-to-toe direction along the top surface of the snowboard boot; and a fastener attached to the first strap portion so that the fastener may be spaced from the first strap portion and entirely grasped in one hand without grasping the first strap portion.

26. The system of claim 25, further comprising a frame attached to the first strap portion and the fastener, wherein the frame is attached to the first strap portion so that the frame and the fastener may be grasped in one hand without grasping the first strap portion.

27. The system of claim 26, further comprising:

at least one guide member attached to the frame and adapted to guide an engagement member into an entrance of the fastener.

28. The system of claim 25, wherein the fastener is attached to the first strap portion so that the fastener is adapted to be moved relatively independently of the first strap portion.

29. The system of claim 25, wherein the fastener includes an entrance and the fastener is adapted to be positioned so that the entrance is beyond an end of the first strap portion.

30. The system of claim 25, further comprising:

a hinge-type connection interconnecting the first strap portion and the fastener.

31. The system of claim 25, further comprising:

at least one guide member adapted to guide an engagement member into an entrance of the fastener.

32. The system of claim 25, wherein the first strap portion is flexible.

33. A snowboard binding system for securing a snowboard boot to a snowboard comprising:

a base constructed and arranged to receive the snowboard boot and adapted for mounting to the snowboard;

a heel hoop attached to the base;

a highback for supporting the rear of the rider's leg that projects upwardly beyond the heel hoop;

an elongated strap extending from the base and across a midline of the snowboard boot that extends in the heel-to-toe direction along the top surface of the snowboard boot, the elongated strap being conformable to the shape of a region of the snowboard boot against which it may be forcibly tightened about;

an engagement member that extends from the base; and a fastener having an entrance for receiving an end of the engagement member, the fastener being mounted to the first elongated strap so that the entrance extends beyond an end of the elongated strap;

wherein the fastener is attached to the elongated strap so that the fastener is adapted to be moved relatively independently of the strap.

34. The system of claim 33, wherein the fastener includes a ratchet buckle having an entrance positioned beyond an end of the elongated strap.

35. The system of claim 33, wherein the elongated strap has a portion thereof constructed and arranged to extend across a midline of the snowboard boot that extends in the heel-to-toe direction along the top surface of the snowboard boot.

36. The system of claim 33, further comprising:

a hinge-type connection interconnecting the elongated strap and the fastener.

37. The system of claim 33, further comprising:

at least one guide member adapted to guide the engagement member into an entrance of the fastener.

38. A snowboard binding system for securing a snowboard boot to a snowboard, comprising:

a base constructed and arranged to receive the snowboard boot and adapted for mounting to the snowboard;

a heel hoop attached to the base;

a highback for supporting the rear of the rider's leg that projects upwardly beyond the heel hoop;

a first elongated strap having a first portion thereof that is constructed and arranged for mounting to the base, the first elongated strap being conformable to the shape of a region of the foot or footwear against which it may be forcibly tightened about;

an engagement member constructed and arranged for mounting to the base; and a fastener associated with the first strap, the fastener having an entrance for receiving an end of the engagement member, the fastener including at least one guide member located forwardly and upwardly of the entrance, the guide member being separate from any release mechanism.

39. The system of claim 38, further comprising at least one guide member positioned one of laterally of the entrance and downwardly of the entrance.

40. The system of claim 38, wherein the fastener is attached to the first strap.

41. The system of claim 38, wherein the at least one guide member is attached directly to the fastener.

42. The system of claim 38, further comprising a frame wherein the fastener is attached to the frame.

43. The system of claim 42, wherein the at least one guide member is attached to the frame.

44. The system of claim 42, wherein at least one of the frame and the fastener is attached to the first strap and the frame comprises a guide member positioned laterally of the entrance and a guide member positioned downwardly of the entrance.

45. The system of claim 38, wherein the at least one guide member has an inclined surface relative to the entrance.

46. The system of claim 38, wherein the at least one guide member defines a tapered introduction area.

47. The system of claim 38, wherein the at least one guide member is attached to the first strap.

48. The system of claim 47, further comprising a hinge-type connection between the fastener and the first strap.

49. The system of claim 48, wherein the hinge-type connection includes a flexible webbing.

50. The system of claim 49, further comprising a guide loop attached to the first strap wherein the flexible webbing passes through the guide loop.

51. The system of claim 50, wherein the first strap is a Y-shaped strap.

52. The system of claim 51, further comprising a frame having a slot, wherein the fastener is attached to the frame and the flexible webbing passes through the slot in the frame.

53. The system of claim 52, wherein the at least one guide member is attached to the frame.

54. The sub-assembly of claim 38, further comprising a hinge, wherein the first elongated strap has a second strap portion that is interconnected to the first strap portion with the hinge.

55. The system of claim 38, wherein the first elongated strap is constructed and arranged to extend across a midline of the snowboard boot that extends in the heel-to-toe direction along the top surface of the snowboard boot.

56. A strap sub-assembly, mountable to an article of footwear or a footwear binding, the strap sub-assembly cooperating with a separate engagement member to provide a variable length strap for engaging at least a portion of the foot or footwear, the strap sub-assembly comprising:

a first elongated strap having a portion thereof that is constructed and arranged for mounting to the foot supporting implement, the elongated strap being conformable to the shape of a region of the foot or footwear against which it may be forcibly tightened about;

a fastener having a frame, the fastener constructed and arranged to secure the engagement member at various locations along the length thereof, and a flexible hinge member that is connected at a first end to the first elongated strap, has a portion passing through an opening in the frame, and is connected at a second end to the first elongated strap;

the fastener being flexibly mounted to the first elongated strap by the flexible hinge member so that the fastener is moveable independent of the first elongated strap in at least two degrees of freedom, facilitating introduction of the engagement member to the fastener.

57. A snowboard binding system for securing a snowboard boot to a snowboard, comprising:

a base constructed and arranged to receive the snowboard boot and adapted for mounting to the snowboard;

a heel hoop attached to the base;

a highback for supporting the rear of the rider's leg that projects upwardly beyond the heel hoop;

a binding engagement member that extends from the base;

a first strap mounted to the snowboard binding, the first strap being flexible and conformable to the shape of a region of the snowboard boot against which it may be forcibly tightened about;

a fastener constructed and arranged to secure the engagement member at various locations along the length thereof; and a hinge that interconnects the first strap and the fastener and includes a hinge member that is more flexible than the first strap so that the fastener is moveable in at least two degrees of freedom without movement of the first strap.

58. The system of claim 57, wherein the first strap is constructed and arranged to extend across a midline of the snowboard boot that extends in the heel-to-toe direction along the top surface of the snowboard boot.

* * * * *